United States Patent [19]

Scalera

[11] 3,958,821

[45] May 25, 1976

[54] DOOR OPERATING ASSEMBLY FOR MERCHANDISING MACHINE OR THE LIKE

[75] Inventor: Frank T. Scalera, Maplewood, N.J.

[73] Assignee: Rowe International Inc., Whippany, N.J.

[22] Filed: Feb. 25, 1974

[21] Appl. No.: 445,824

[52] U.S. Cl. ..... 292/97; 70/208; 292/26; 292/240

[51] Int. Cl.[2] ..... E05C 19/10

[58] Field of Search ..... 70/208; 292/97, 98, 292/100, 111, 113, 240, 241, 242, 110, 26

[56] References Cited

UNITED STATES PATENTS

| | | | |
|---|---|---|---|
| 2,201,963 | 5/1940 | Wartian | 70/208 |
| 2,750,217 | 6/1956 | Landholf | 292/97 |
| 2,767,008 | 10/1956 | Oswald | 292/241 |
| 3,045,465 | 7/1962 | Larson | 70/153 |
| 3,217,661 | 11/1965 | Kemp | 292/241 X |

FOREIGN PATENTS OR APPLICATIONS

| | | | |
|---|---|---|---|
| 1,266,663 | 4/1964 | Germany | 70/208 |

*Primary Examiner*—Robert L. Wolfe
*Attorney, Agent, or Firm*—Shenier & O'Connor

[57] ABSTRACT

A door operating assembly for a merchandising machine or the like in which a pivoted handle normally retained in a recessed position on the merchandise machine cabinet door by means of a key operated lock is biased in both directions to a ready position out of the recess at which it is accessible to permit the handle to be moved to a fully open position in the course of which movement it drives a latching member to cause a first cam surface thereon to engage a strike in the cabinet positively to initiate movement of the door toward its open position. Upon release of the handle it returns to the ready position so that to close the door the handle first is moved to fully open position, the door is swung toward the cabinet to permit the latching member to receive the strike and the handle is then moved to fully closed position in the course of which movement it drives the latching member to cause a second cam surface thereon to engage the strike to exert a lifting force on the door as it moves to fully closed position to permit the lock to be operated to lock the handle in its recessed position.

3 Claims, 9 Drawing Figures

Fig 6
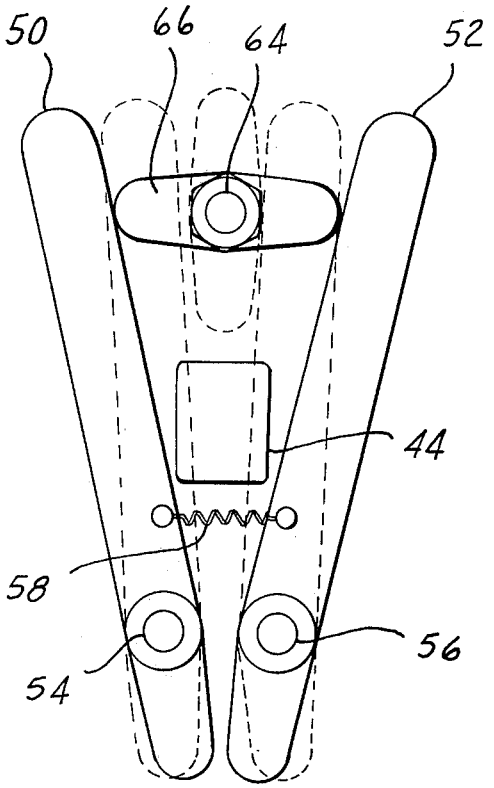
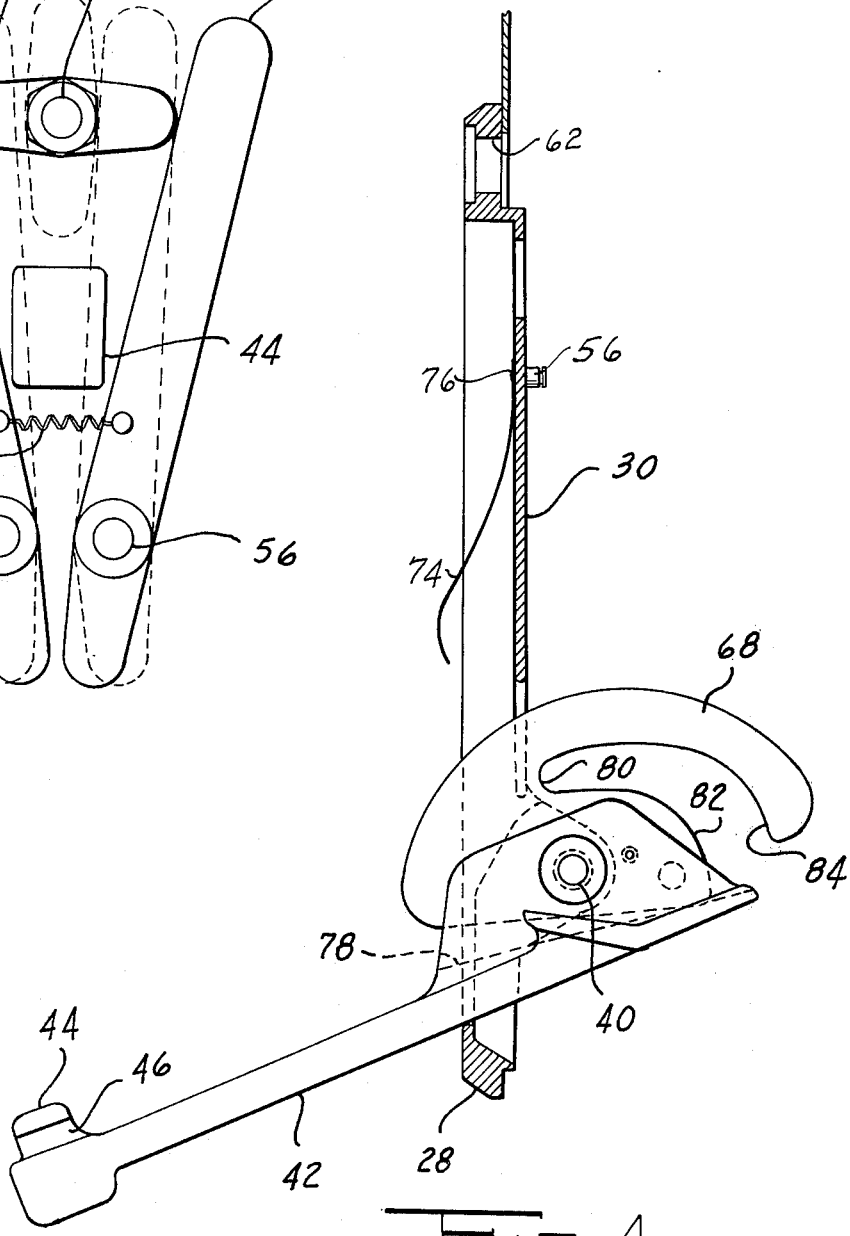
Fig 4

DOOR OPERATING ASSEMBLY FOR MERCHANDISING MACHINE OR THE LIKE

BACKGROUND OF THE INVENTION

Cabinets for merchandising machines adapted to dispense various articles or substances in response to the deposit of money in the machine usually have large doors covering substantially the entire front of the machine and adapted to be swung open on a hinge for servicing of the machine. In addition, in many of the merchandising machines of the prior art, components of the assembly are mounted on the inside of the door. For example, in a machine which is adapted to deliver principal articles of merchandise such as bars of candy or the like, customarily a gum and mint unit is mounted on the inside of the door. In a beverage merchandising machine the cup delivery mechanism may be on the door. Owing to their size and to the equipment supported thereon merchandising machine doors are relatively heavy. A further requirement of a merchandising machine is that the door normally be locked to prevent access to the interior by unauthorized persons.

Many merchandising machines of the prior art are not provided with door handles for facilitating movement of the door from closed to open position. Owing to their great weight, many of the doors develop a "sag" after a period of time in use resulting in difficulty in moving the door to its open position after it has been unlocked and to the difficulty of closing the door. Even where the door of a merchandising machine is provided with a handle, difficulties have been encountered owing to the ease with which the projecting handle is damaged. In order to service the machine the operator must move the door to its fully open position. Moreover, owing to his preoccupation with the task of loading the machine with merchandise the serviceman cannot exercise any great degree of care in protecting the handle against damage. As a result the handle may be forcibly moved into contact with an adjacent wall or with a machine at the same general location and thus be damaged.

In addition to the foregoing, most large merchandising machines of the prior art are provided with handles of the screw-in type which must first be unlocked and then unscrewed to permit the door to be opened and which must be screwed in and locked after the door has again been closed. It will be appreciated that these operations take an inordinate amount of time for a routeman who is servicing a large number of machines or who is trouble-shooting during peak sales hours. Further, some handle assemblies of the prior art have openings through which wires or other probes can be inserted by vandals or by dishonest persons attempting to cheat the machine.

I have invented a door operating assembly for a merchandising machine which overcomes the difficulties incident to opening and closing merchandising machine cabinet doors of the prior art. My operating assembly overcomes the problem of door sag. It positively cams the door toward its open position in response to a relatively small manual effort. It exerts a lifting force on the door as the door is moved to its fully closed position. When the door lock is opened the operating handle of my assembly pops out to a position at which it is accessible to the operator but at which it is not readily damaged. My assembly is fast acting both in the opening and closing operations as compared with screw type handle assemblies of the prior art. It is so constructed as to inhibit the introduction of wires or other probes into the machine through the handle assembly. My operating assembly is simple in construction and in operation for the results achieved thereby.

SUMMARY OF THE INVENTION

One object of my invention is to provide a door operating assembly for a merchandising machine or the like.

Another object of my invention is to provide a door operating assembly for a merchandising machine which overcomes the difficulty incident to operating the doors of merchandising machines of the prior art.

A further object of my invention is to provide a door operating assembly for a merchandising machine which overcomes the effect of door sag.

Another object of my invention is to provide a merchandising machine door operating assembly which positively cams the door toward its open position in response to a relatively light manual force exerted on the operating handle thereof.

A still further object of my invention is the provision of a merchandise machine door operating assembly which is quick acting both on the opening and on the closing operations.

Yet another object of my invention is to provide a door operating assembly for a merchandising machine which exerts a lifting force on the door as it is moved into its fully closed position.

Still another object of my invention is to provide a merchandising machine door operating assembly which inhibits the introduction of wires or other probes through the assembly.

A still further object of my invention is to provide a merchandise machine door operating assembly the handle of which pops to an accessible position in response to opening of a key-operated lock.

Still another object of my invention is to provide a merchandising machine door operating assembly the handle of which is protected against damage.

Other and further objects of my invention will appear from the following description.

In general, my invention contemplates the provision of a door operating assembly for a merchandising machine in which a slotted latching member mounted for rotary movement on the door normally receives a strike on the cabinet and in which an operating handle pivotally supported on the latching member axis normally is held in a recessed position on the door by a key-operated lock and is biased in both directions toward an intermediate position at which it is accessible so as to be able to be moved to a fully open position in the course of which movement it drives the latching member to close a first cam surface along one edge of the slot to engage the strike positively to move the door from its closed towards its fully open position. Upon its release the handle returns to the ready position from which it can be moved to fully open position in which the latching member slot can receive the strike as the door moves towards its closed position. As the handle is returned to its recessed position, a second cam surface along the other edge of the slot engages the strike to exert a lifting force on the door as it moves to its fully closed position.

BRIEF DESCRIPTION OF THE DRAWINGS

In the accompanying drawings which form part of the instant specification and which are to be read in conjunction therewith and in which like reference numerals are used to indicate like parts in the various views:

FIG. 4 is a fragmentary sectional view of my operating assembly for a merchandising machine door illustrating the parts thereof in their fully open positions.

FIG. 6 is a fragmentary rear elevation of my operating assembly for a merchandising machine door illustrating the handle locking mechanism thereof and taken along the line 6—6 of FIG. 3 and drawn on an enlarged scale.

DESCRIPTION OF THE PREFERRED EMBODIMENT

Figure 1:
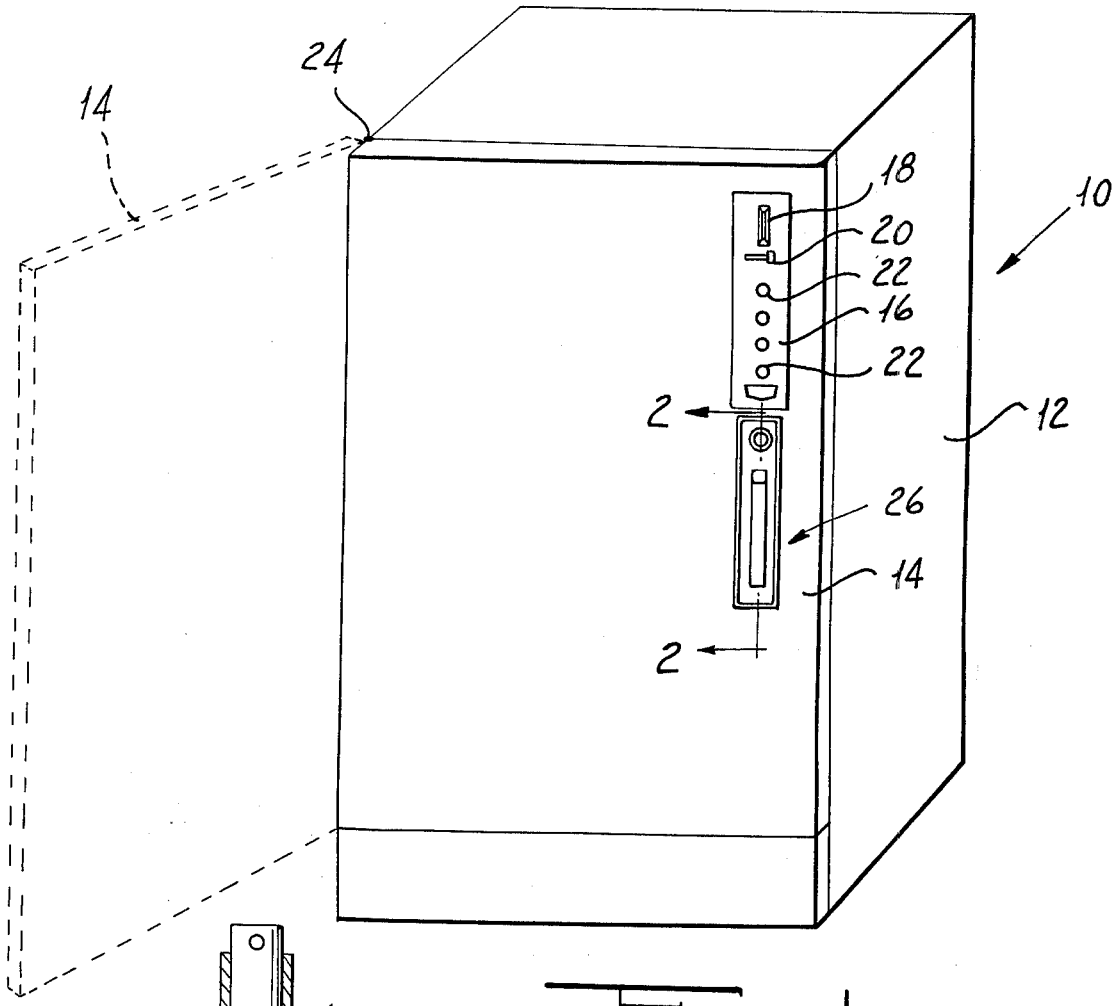
FIG. 1 is a perspective view of a merchandising machine provided with my door operating assembly.
Figure 5:
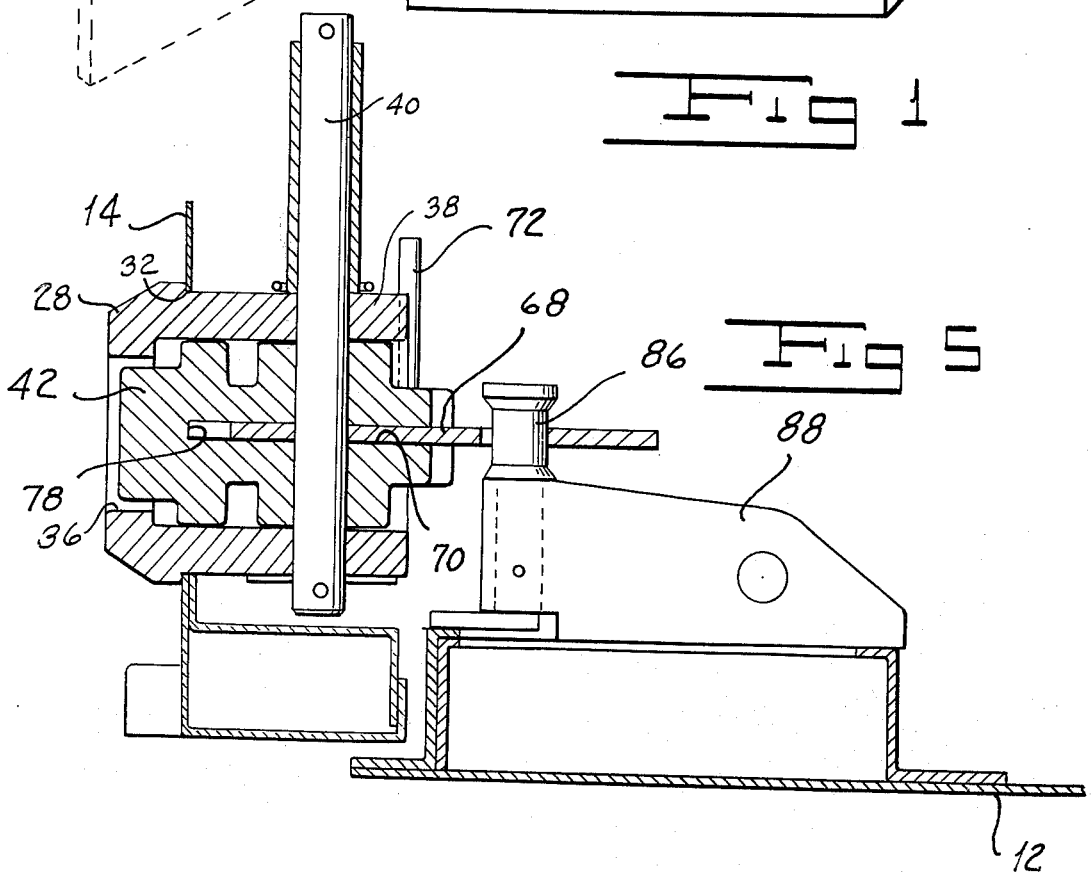
FIG. 5 is a fragmentary sectional view of my operating assembly for a merchandising machine door or the like taken along the line 5—5 of FIG. 2 and drawn on an enlarged scale.

Referring now to the drawings, a merchandising machine or the like, indicated generally by the reference character 10, includes a cabinet 12 provided with a door 14 covering substantially the entire front of the cabinet 12. Door 14 carries a panel 16 which supports the coin slot 18, a coin return lever 20 and a plurality of selecting buttons 22 associated with the coin mechanism and selecting mechanism of the machine (not shown). Door 14 may be supported by means of a hinge 24 for movement from the closed position illustrated in full lines in FIG. 1 to a fully open position illustrated in broken lines. Further, the door 14 may support other mechanisms of the machine such, for example, as a cup delivery mechanism (not shown) in the event that the machine is adapted to dispense beverages, or for example, a gum and mint delivery unit (not shown) where the machine is adapted to deliver candy bars together with gum and mint packets. Other various components may be carried by the door thus adding to its weight.

My door operating assembly, indicated generally by the reference character 26, includes a frame 28 having a base 30. I assemble the frame 28 in an opening 32 in the door 14 by any suitable means such, for example, as by screws 34.

Base 30 is formed with an opening 36 adjacent to the lower end of the frame. A mounting bracket 38 at the opening 36 supports a shaft 40. I mount the handle 42 of my assembly 26 on shaft 40. Handle 42 includes a head 44 connected to the handle by a neck 46. In the fully closed position of the assembly the neck 46 extends through an opening 48 adjacent to the upper end of base 30 to position head 44 behind the base 30.

I mount a pair of locking fingers 50 and 52 for pivotal movement on stub shafts 54 and 56 extending inwardly from the base 30. A spring 58 normally urges the fingers 50 and 52 together to positions at which they engage the neck 46 behind the head 44 to lock the handle 42 in its fully closed position.

My assembly includes a barrel lock 60 of any suitable type known to the art mounted in a bore 62 in the upper end of the frame 28. Lock 60 includes a shaft 64 carrying a cam 66 positioned between the upper ends of the locking fingers 50 and 52. In one position of the cam 66 illustrated in broken lines in FIG. 6, the spring 58 positions fingers 50 and 52 at locations at which they can hold the handle 28 in its fully closed position. When the lock is operated, shaft 64 rotates through 90° to cause the cam 6 to separate the fingers 50 and 52 and to move them to positions illustrated in full lines in FIG. 6 at which the head 44 is free to permit the handle 28 to spring to its "pop-out" position in a manner to be described.

Figure 2:
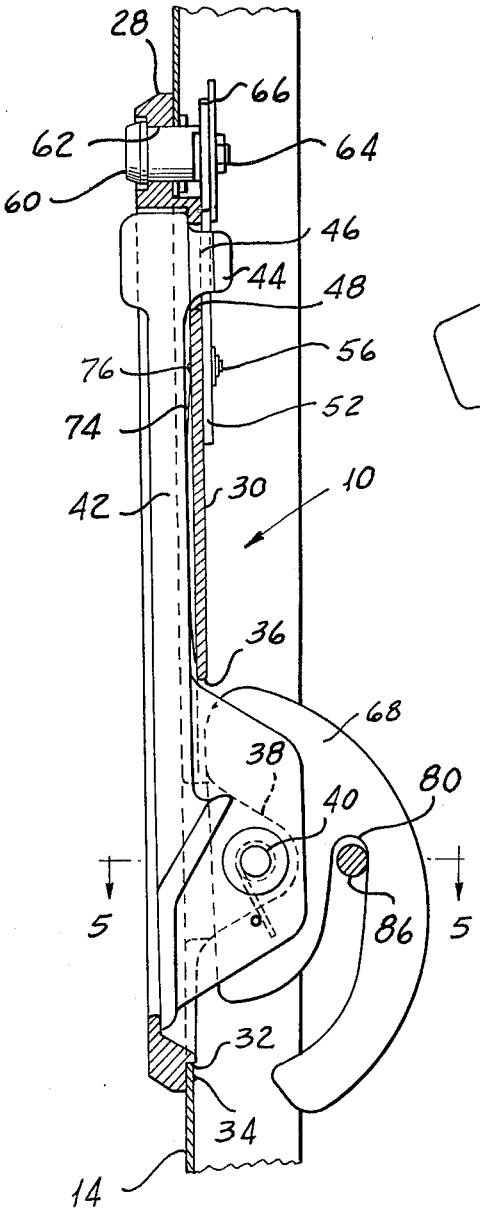
FIG. 2 is a fragmentary sectional view of the machine shown in FIG. 1 taken along the line 2—2 of FIG. 1 and drawn on an enlarged scale.

My assembly includes a latching member 68 rotatably supported on the shaft 40 and disposed in a recess 70 formed in the hub of the handle 42. I provide my assembly with a torsion spring 72 one end of which is attached to the bracket 38 and the other end of which is attached to the handle 42 and so arranged as to bias the handle to its closed position illustrated in FIG. 2. A leaf spring 74 secured to the base 30 by any suitable means such as by a screw 76 engages the inner surface of the handle 42 to bias it to move in a counterclockwise direction as viewed in FIG. 3. I so arrange the springs 72 and 74 that the spring 74 overcomes the force of spring 72 when the handle is unlocked to bias it to a pop-out position in which it is held by spring 72. In this position, the handle 42 is accessible to the operator. While being accessible, however, it is partially retracted so that it is less likely to be damaged by contact with a wall or with another machine in the vicinity of the machine carrying the operating handle assembly. I form the slot 70 in the handle 30 with an inclined base 78 which is adapted to engage the upper portion of locking member 68 when the handle is fully closed and to engage a lower portion of the member 68 as the handle is moved from its pop-out position to its fully open position to be described. Between these two positions, there is a predetermined amount of angular lost motion.

I form the locking member 68 with a generally curved slot 80 defined by respective edges 82 and 84 which are slightly divergent. This slot is adapted to receive a strike 86 mounted on a bracket 88 in the machine cabinet.

In use of the form of my door operating assembly shown in FIGS. 1 to 6, with the handle 42 in the locked up position, head 44 is behind the opening 48 and the two fingers 50 and 52 are biased into engagement with the neck 46. This is the broken line position of parts illustrated in FIG. 6 and the full line position of the parts illustrated in FIG. 2. In this position, the handle is disposed within the frame 28 so as to be substantially flush with the surface of the door 14 of the cabinet 10.

When the operator desires to open the door, he first rotates lock shaft 64 through 90° by means of a suitable key in a manner known to the art. As the shaft 64 rotates through 90° to the full line position shown in FIG. 6, cam 66 moves fingers 50 and 52 out from behind the head 44 to free the handle 42. With the handle thus freed, the leaf spring 74 rotates the handle in a counterclockwise direction as viewed in FIGS. 2 to 4. This rotation is against the action of spring 72 and continues until spring 74 is fully extended at which time spring 72 holds the handle in that position at which it is accessible to the operator. In the course of this movement, locking member 68 does not rotate but remains in engagement with the strike 86. The inclined base 78 of slot 70 permits this lost motion. Next, the operator grasps the handle 42 and rotates it further in a clockwise direction to the fully open position illustrated in FIG. 4. In the course of this movement, edge 82 of slot 80 engages the strike 86 to cam the door 14 from its fully closed position towards its open position. Finally the strike 86 emerges from the slot 80 and the handle may be pulled to move the door to its fully open position. When the door is fully open, the operator releases the handle 42 and spring 72 moves it back to its pop-out position. As is pointed out hereinabove, the handle in this position is not likely to be damaged by contact with surrounding objects or surfaces.

Figure 3:
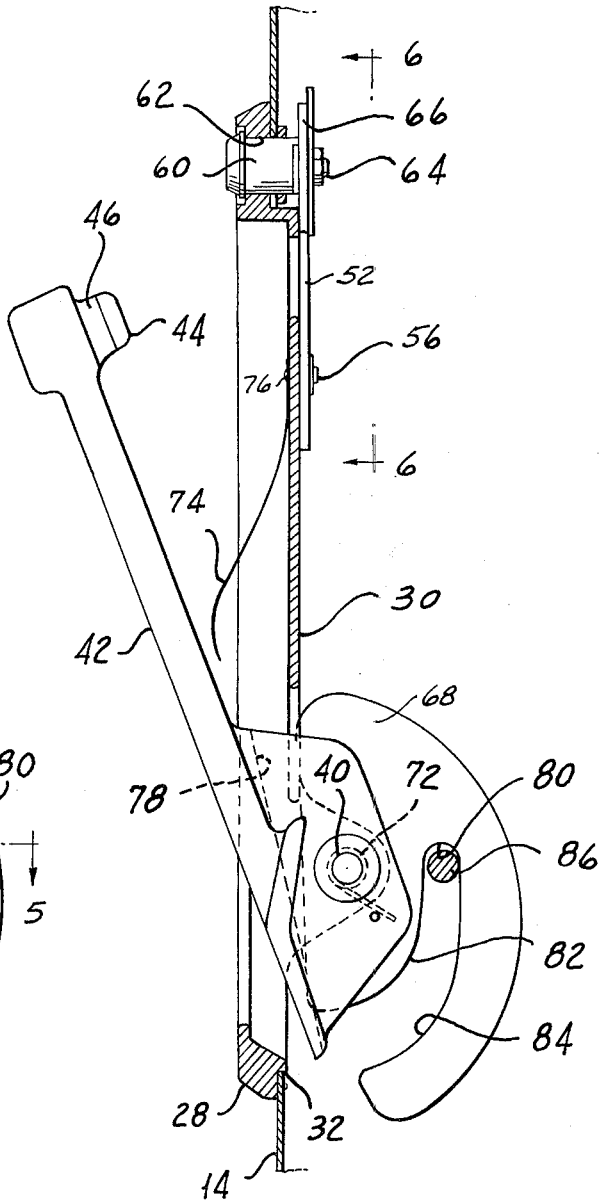
FIG. 3 is a fragmentary sectional view of my operating assembly for a merchandise machine door or the like illustrating the pop-out position of the handle of the assembly.

When the operator has completed his task of servicing the machine and he wishes to return the door to its closed position, he first moves the handle from its ready position illustrated in FIG. 3 to the position shown in FIG. 4 and swings the door towards its closed position. As the strike 86 enters the mouth of slot 80 it engages the lower end of the handle 42 to initiate movement of the handle towards its closed position. When the operator senses this action, he rotates the handle toward its fully closed position. In the course of this movement of the handle, surface 84 engages strike 86 and, as the handle is moved to its fully closed position, a lifting force is exerted on the door 14. This lifting force tends to overcome any sag which may present in the door to facilitate movement of the door to its fully closed position.

In the course of unlocking the machine to open the door the operator returns the key to its initial position after the handle has moved to pop-out position. When that is done fingers 50 and 52 are restored to their initial positions so that, when the door is moved to its fully closed position head 44 first cams the fingers out of its path and then permits them to snap back into position behind the head. Thus the door is closed and locked by one motion of the operator.

Figure 7:
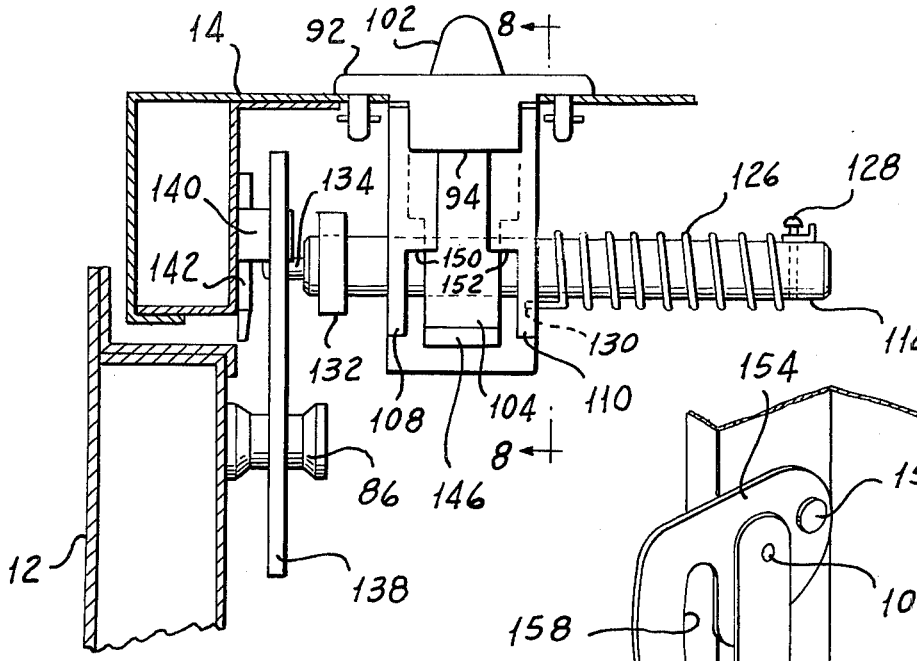
FIG. 7 is a fragmentary sectional view of a merchandising machine provided with an alternate form of my door operating assembly.
Figure 8:
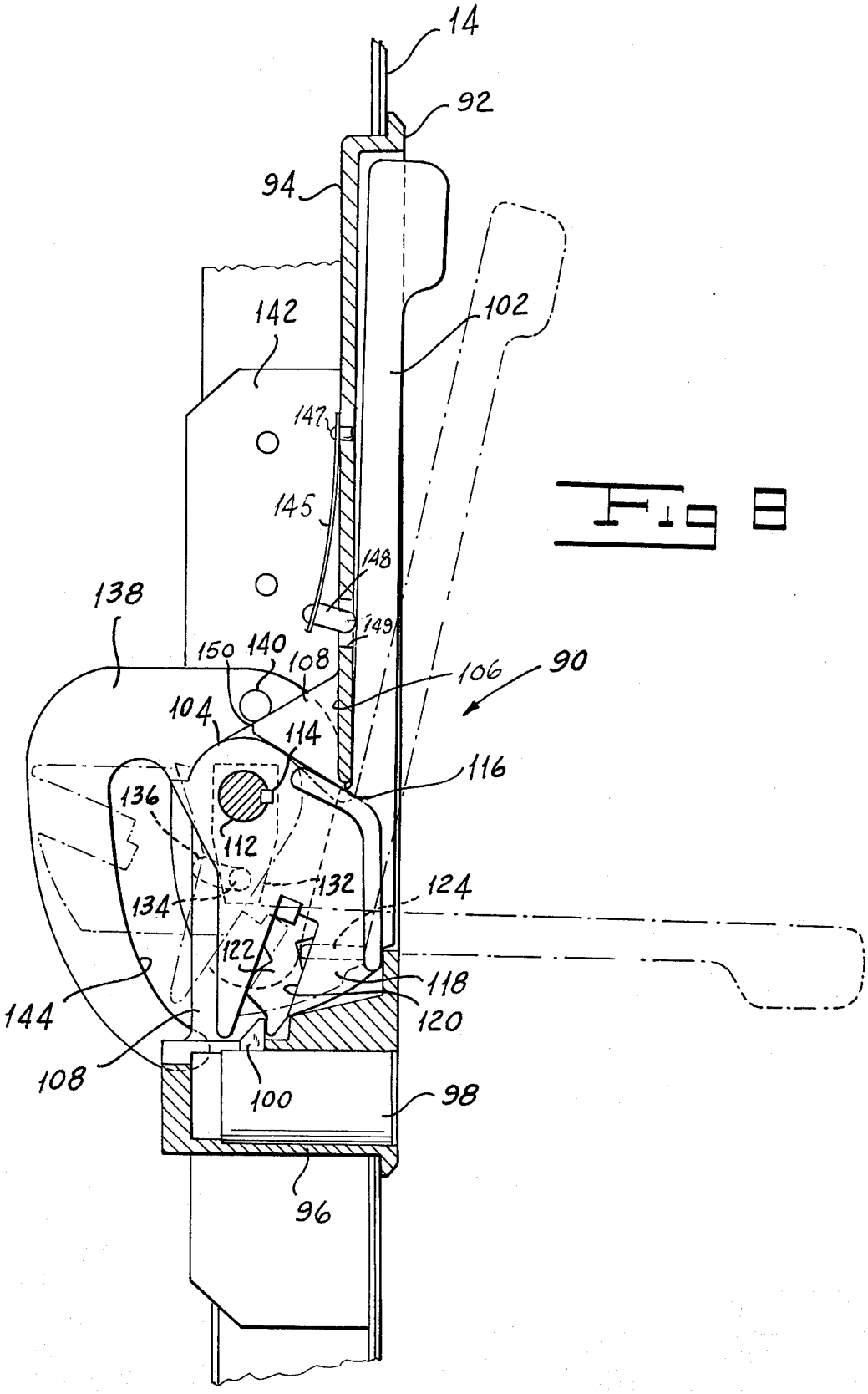
FIG. 8 is a sectional view of the form of my door operating assembly shown in FIG. 7 and taken along the line 8—8 thereof.

Referring now to FIGS. 7 and 8, a preferred form of my door operating assembly is adapted for use with a merchandising machine having a cabinet 12 and a door 14 having an opening for receiving the assembly. The assembly 90 includes a frame 92 adapted to be secured in the door opening by any suitable means. Frame 92 has a base 94 against which the handle to be described hereinbelow rests in the closed position of the door. I form the lower end of the frame with a lock housing 96 adapted to receive a lock 98 which preferably is a pick resistant lock. Lock 98 includes a catch 100 which is spring loaded to a position at which it extends above the housing 96. As will be explained hereinbelow, I so arrange my assembly 90 as to be able to be used with a relatively short lock 98 or with a longer lock.

The assembly 90 includes a handle 102 formed with a hub 104 adapted to be received in a hub recess 106 formed by a pair of sides 108 and 110 integrally formed with the frame 92 and with the lock housing 96. A shaft 112 rotatably supported in the sides 108 and 110 is secured to the hub 104 by any suitable means such as by a key 114. Handle 102 extends outwardly from the hub 104 through an opening 116 in the base 94 of the frame 92.

I form the hub 104 with a strike receptacle 118 having a recess 120 which removably holds a strike 122 held in place in the recess by a set screw 124 or the like. Strike 122 is so shaped as to be reversible. When mounted in the recess 120 with the orientation shown in FIG. 8 the strike 122 is adapted to cooperate with the relatively short lock 98. The set screw may be loosened and the strike 122 can be reversed so as to permit it to cooperate with a relatively longer lock if desired.

A coil spring 126 carried by shaft 112 has one end in engagement with a pin 128 carried by the shaft 112. The other end of the spring is inserted in a hole 130 or the like in side 110. Spring 126 is so wound that it urges the handle 102 to rotate in a counterclockwise direction as viewed in FIG. 8 from the fully open position to the pop-out position. A leaf spring 145 mounted on the inside of base 94 by a rivet 147 carries a lug 148 extending through an opening 149 in base 94 and into engagement with the handle to urge the handle from the fully closed position shown in full line to the pop-out position when lock 98 is unlocked to open the door.

I mount a crank 132 on shaft 112 for rotation therewith by any suitable means such as by a set screw or the like. Crank 132 carries a crank pin 134 adapted to engage in an arcuate slot 136 formed in the cam plate 138 of the assembly 90. I rotatably mount the cam plate 138 on a pivot pin 140 carried by a bracket 142 secured to the door 14. Cam plate 138 is formed with a slot 144 similar to the slot 80 in the cam plate 68 shown in FIGS. 1 to 6.

I form the hub 104 with a stop 146 adapted to engage stops 150 and 152 on the sides 108 and 110 in the fully open position of the handle 102.

Figure 9:
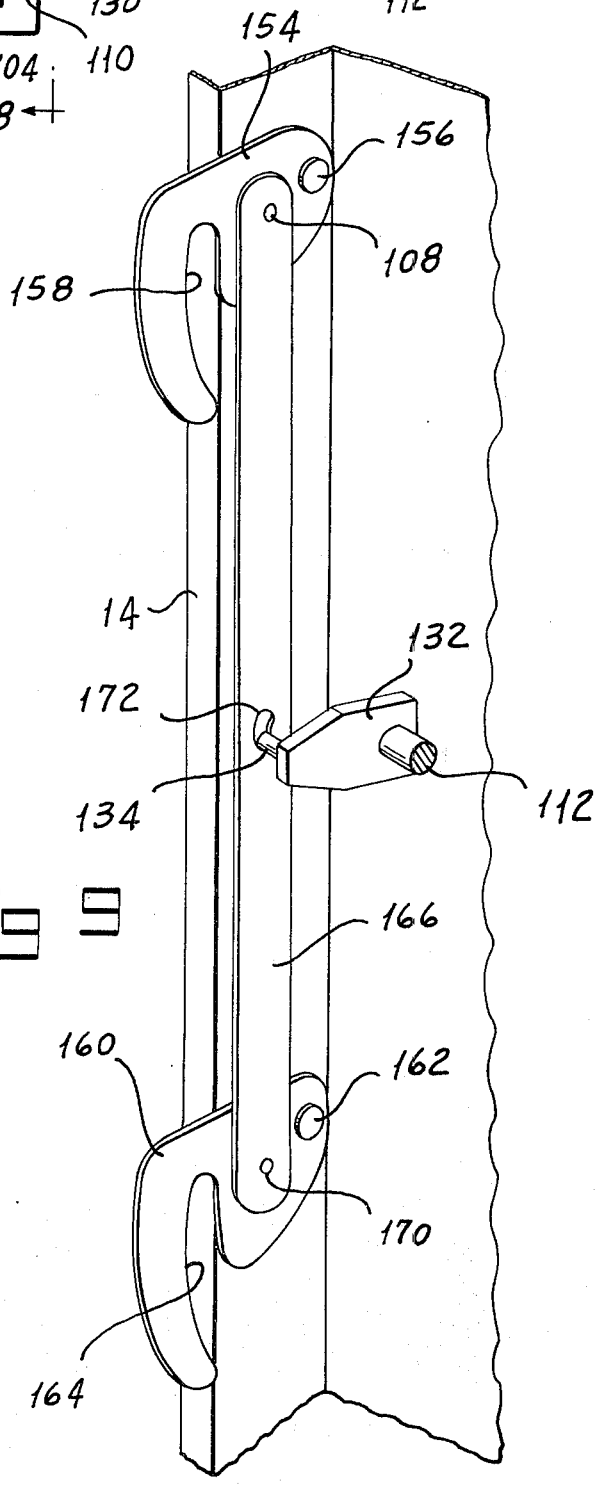
FIG. 9 is a fragmentary perspective view of yet another embodiment of my door operating assembly.

Referring now to FIG. 9 in a further modification of the assembly 90 illustrated in FIGS. 7 and 8, I provide the door 14 with a first cam plate 154 pivotally supported on a pin 156 at one location along the length of the door. Cam plate 154 has a slot 158 adapted to cooperate with a suitable pin on the cabinet 12. I mount a second cam plate 160 for pivotal movement on a pin 162 at a location along the length of the door spaced from the location of pin 156. Cam plate 160 has a slot 164 adapted to cooperate with a second pin (not shown) spaced along the height of the cabinet at a location spaced from that of the pin which cam plate 154 cooperates with. A link 166 is connected at its respective ends to the cam plates 154 and 160 by pins 168 and 170. I provide the link 166 with an arcuate slot 172 adapted to receive the crank pin 134 carried by crank 132 on shaft 112.

In use of the assembly 90 illustrated in FIGS. 7 and 8 in the fully locked up position of the handle 102 illustrated in full lines in FIG. 8, catch 100 is behind the strike 122 to hold the handle in its retracted position against the action of spring 126. When the cabinet is to be opened, the serviceman or the like operates lock 98 to withdraw the catch 100 from behind the strike 122. When that occurs, spring 145 urges the handle to an intermediate position illustrated in dot-dash lines in FIG. 8. In this position, pin 134 has ridden to the other end of the arcuate slot 136 and the handle is readily accessible to the serviceman. Next, the serviceman moves the handle 102 to the fully open position until stop 146 engages stops 150 and 152. In the course of this movement, opening movement of the door is initiated. When the handle 102 is released spring 126 moves it back from fully open position to the pop-out position. When the door is to be closed, it is pushed shut and the handle 102 is moved from the fully open position to the fully closed position to cause the strike 122 to ride behind the catch 100 to lock the door.

It will be appreciated that the form of my assembly illustrated in FIGS. 7 to 9 has a number of advantages. First, it is of universal application in that it can be used with a cam positioned at any location. That is to say, the cam plate is not incorporated as an element of the handle assembly although a connection thereto is readily established. Moreover it permits of the double cam plate arrangement of FIG. 9 which is especially adapted for use with large doors. In addition to these features, the location of the lock below the handle provides better security and it enables the operator to turn the key to release the lock without the handle striking his knuckles. Further owing to thie arrangement, the handle assembly is narrower than is the arrangement illustrated in FIGS. 1 to 6.

It will be seen that I have accomplished the objects of my invention. I have provided an operating assembly for a merchandising machine door which facilitates movement of the door out of and into its closed positions. My assembly incorporates a handle which pops out to a readily accessible position as soon as the door lock is released. My assembly provides a cam action which initiates movement of the door from its fully closed to its fully open position in response to a relatively light manual force. My assembly exerts a lifting action on the door as the operating assembly moves to its closed position to overcome the problem of door sag. The handle of my assembly is protected against damage. My assembly is quicker acting than are handle assemblies of the screw-in type known in the prior art. It inhibits the introduction of wires or other probes through the handle assembly. My assembly is simple and reliable in operation.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. An operating assembly for a merchandising machine cabinet door including in combination, a merchandising machine cabinet having an open front, a door adapted to close said front, a hinge mounting said door along a vertical edge thereof on said cabinet for swinging movement between an open position permitting access to the interior of said cabinet through said front and a closed position over said front, a strike mounted on said cabinet, a latching member, means mounting said latching member on said door for movement around a first generally horizontal axis between a first position in engagement with said strike and a second position out of engagement with said strike, an operating handle, means comprising a shaft mounting said operating handle on said door for movement around a second generally horizontal axis between a home position and a fully open position, said second axis being spaced from said first axis, and means responsive to movement of said handle from said fully open position to said home position for moving said latching member from its second position to its first position, said latching member moving means comprising a crank carried by said shaft and a crank pin carried by said crank for driving said latching member, said latching member formed with a cam surface which engages said strike to exert a lifting force on said door as said latching member moves to its first position in response to movement of said handle to its home position to overcome sag in the door to facilitate movement of the door to a fully closed position.

2. An operating assembly as in claim 1 in which said latching member is formed with an arcuate slot for receiving said crank pin.

3. An operating assembly for a merchandising machine cabinet door including in combination, a merchandising machine cabinet having an open front, a door adapted to close said front, a hinge mounting said door along a vertical edge thereof on said cabinet for swinging movement between an open position permitting access to the interior of said cabinet through said front and a closed position over said front, a strike mounted on said cabinet, a latching member formed with a curved slot adapted to receive said strike, means mounting said latching member on said door for pivotal movement around a first axis between a first position at which said slot receives said strike and a second position at which said strike is clear of said slot, a handle, means comprising a shaft mounting said handle on said door for pivotal movement around a second axis spaced from said first axis and between a closed position and an open position, means for biasing said handle to a ready position between said open position and said closed position, releasable means for holding said handle in said closed position against the action of said biasing means, and means responsive to movement of said handle from said closed position to said open position for moving said latching member from its first position to its second position, said means responsive to movement of said handle providing lost motion between said handle and said latching member as said handle moves from said closed position to said intermediate position, said means responsive to movement of said handle comprising a crank on said shaft and a pin and slot connection between said crank and said latching member, said latching member including a first cam surface along one edge of said slot for engaging said strike as said handle moves from said intermediate position to said open position to initiate movement of said door toward its open position, said latching member including a second cam surface along the other edge of said slot for engaging said strike as said latching member moves into its first position to exert a lifting force on said door.

* * * * *